US012188382B2

(12) United States Patent
Raimondi et al.

(10) Patent No.: US 12,188,382 B2
(45) Date of Patent: Jan. 7, 2025

(54) ROCKER ARMS

(71) Applicant: Eaton Intelligent Power Limited, Dublin (IE)

(72) Inventors: Emanuele Raimondi, Collegno (IT); Massimo D'Amore, Almese (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/999,625

(22) PCT Filed: May 28, 2021

(86) PCT No.: PCT/EP2021/025195

§ 371 (c)(1),
(2) Date: Nov. 22, 2022

(87) PCT Pub. No.: WO2021/239273

PCT Pub. Date: Dec. 2, 2021

(65) Prior Publication Data

US 2023/0235685 A1 Jul. 27, 2023

Related U.S. Application Data

(60) Provisional application No. 63/032,173, filed on May 29, 2020.

(51) Int. Cl.

| | |
|---|---|
| ***F01L 1/18*** | (2006.01) |
| ***F01L 13/00*** | (2006.01) |
| *F01L 1/46* | (2006.01) |

(52) U.S. Cl.

CPC ..... *F01L 1/181* (2013.01); *F01L 13/0005* (2013.01); *F01L 2001/186* (2013.01); *F01L 2001/467* (2013.01); *F01L 2305/02* (2020.05)

(58) Field of Classification Search

CPC ..... F01L 1/181; F01L 2001/186; F01L 2001/467; F01L 13/0005

(Continued)

(56) References Cited

U.S. PATENT DOCUMENTS 5,107,803 A * 4/1992 Furnivall ..... F01L 1/185 123/90.39
9,057,291 B2 * 6/2015 Jeon ..... F01L 1/181

(Continued)

FOREIGN PATENT DOCUMENTS

CN 110685768 A 1/2020
EP 1712748 A1 10/2006

(Continued)

OTHER PUBLICATIONS

International Search Report issued in corresponding application No. PCT/EP2021/025195 dated Sep. 15, 2021, 3 pages.

(Continued)

*Primary Examiner* — Jorge L Leon, Jr.
(74) *Attorney, Agent, or Firm* — Meunier Carlin & Curfman LLC

(57) ABSTRACT

A rocker arm assembly can include an outer arm having an outer rocker shaft bore configured to receive a rocker shaft and an inner arm having an inner rocker shaft bore configured to receive the rocker shaft. The inner arm can be configured to selectively rotate. A latch pin can be movably seated in the outer arm and configured to move between a latched position and an unlatched position. The rocker arm assembly can further include a lost motion spring. The lost motion spring can include a first end connected to a connecting portion of the inner arm above the inner rocker shaft bore and a second end connected to the outer arm. The inner (Continued)

arm can include an inner arm stop member configured contact with a corresponding outer arm stop member of the outer arm.

18 Claims, 3 Drawing Sheets

(58) Field of Classification Search
USPC ..... 123/90.39, 90.44
See application file for complete search history.

(56) References Cited

U.S. PATENT DOCUMENTS

| | | | | |
|---|---|---|---|---|
| 10,781,729 | B1 * | 9/2020 | Foster | F01L 13/0021 |
| 11,181,012 | B2 * | 11/2021 | Alexandru | F01L 1/2416 |
| 2016/0281612 | A1 * | 9/2016 | Toth | F01L 1/18 |
| 2017/0009610 | A1 * | 1/2017 | Ahmed | F01L 1/2416 |
| 2017/0198610 | A1 * | 7/2017 | Haefner | F01L 1/181 |
| 2017/0284237 | A1 * | 10/2017 | Shewell | F01L 1/24 |
| 2017/0284313 | A1 * | 10/2017 | Shewell | F01L 1/2416 |
| 2018/0266282 | A1 * | 9/2018 | Nagaraj | F01L 13/0021 |
| 2019/0178113 | A1 * | 6/2019 | McCarthy, Jr. | F01L 13/065 |
| 2021/0047947 | A1 * | 2/2021 | Van Wingerden | F01L 1/267 |
| 2022/0074321 | A1 * | 3/2022 | Hollweck | F01L 1/181 |

FOREIGN PATENT DOCUMENTS

| | | | | |
|---|---|---|---|---|
| GB | 2333322 | A | 7/1999 | |
| WO | WO-2006090292 | A2 * | 8/2006 | F01L 1/18 |
| WO | 2020/030298 | A | 2/2020 | |
| WO | 2021047797 | A1 | 3/2021 | |

OTHER PUBLICATIONS

Written Opinion issued in corresponding application No. PCT/EP2021/025195 dated Sep. 15, 2021, 8 pages.

* cited by examiner

ROCKER ARMS

CROSS-REFERENCE TO RELATED APPLICATIONS

This is a National Stage application of PCT international application PCT/EP2021/025195 filed on May 28, 2021, which claims the benefit of priority of U.S. Provisional Patent Application No. 63/032,173, filed May 29, 2020, each of which is incorporated herein by reference in its entirety.

FIELD

This application relates to rocker arm assemblies, and more particularly to a switchable rocker arm assembly for use in, for example, a valve train of an internal combustion engine. Deactivation and other variable valve actuation techniques can be accomplished.

DESCRIPTION OF RELATED ART

An internal combustion engine includes a valve train assembly. A valve train assembly includes rocker arms for controlling opening and closing of intake and exhaust valves. A rocker arm is a reciprocating lever that translates radial motion of a rotating camshaft lobe into linear motion that controls the opening and closing of a valve. A rocker arm is mounted on a rocker shaft with one end in direct or indirect contact with the rotating camshaft lobe and the other end being structurally interfaced with a valve.

Variable valve actuation mechanisms, such as cylinder deactivation and variable valve lift, have been introduced to improve engine performance, fuel economy and/or emissions of an internal combustion engine during periods of light engine load. To support a variable valve actuation mechanism, a switchable rocker arm can be used. A switchable rocker arm includes a pair of arms that are rotatably coupled to one another. The pair of arms are switchable between a latched state, in which they are prevented from rotating relative to one another, and an unlatched state, in which they are permitted to rotate relative to one another.

The description provided herein is for the purpose of generally presenting the context of the disclosure. Work of the presently named inventors, to the extent it is described in this section, as well as aspects of the description that cannot otherwise qualify as prior art at the time of filing, are neither expressly nor impliedly admitted as prior art against the present disclosure.

SUMMARY

To attain the advantages and in accordance with the purpose of the disclosure, as embodied and broadly described herein, one aspect of the disclosure can provide that a rocker arm assembly can include an outer arm comprising an outer rocker shaft bore configured to receive a rocker shaft and an inner arm comprising an inner rocker shaft bore configured to receive the rocker shaft. The inner arm can be configured to selectively rotate relative to the outer arm via the rocker shaft extended through the outer rocker shaft bore and the inner rocker shaft bore. The rocker arm assembly can also include a latch pin movably seated in the outer arm and configured to move between a latched position, in which the latch pin engages with the inner arm to lock the relative rotation between the inner arm and the outer arm, and an unlatched position, in which the latch pin disengages with the inner arm to allow the relative rotation between the inner arm and the outer arm. The rocker arm assembly can further include a lost motion spring. The lost motion spring can include a first end connected to a connecting portion of the inner arm above the inner rocker shaft bore and a second end connected to the outer arm. The inner arm can include an inner arm stop member configured contact with a corresponding outer arm stop member of the outer arm, where the inner arm stop member extends below the inner rocker shaft bore from a side substantially opposite to the portion of the inner arm above the inner rocker shaft bore.

According to another exemplary aspect, the outer arm can comprise a roller configured to interface with a camshaft lobe of a type III valve train assembly. The roller can be located laterally from the rocker shaft, and the latch pin can be located above the roller. In some exemplary aspects, the second end of the lost motion spring can be connected to a portion of the outer arm that is located approximately between the roller and the rocker shaft. In another exemplary aspect, the second end of the lost motion spring can be connected to a portion of the outer arm that is located approximately between the rocker shaft and the latch pin.

In still another exemplary aspect, the outer arm can comprise a latch pin seat for receiving the latch pin, where the latch pin seat can comprise a flange fixed thereto on a side away from the inner arm and a return spring disposed between the flange and the latch pin to bias the latch pin towards the inner arm.

According to yet another exemplary aspect, the latch pin can comprise an indented flat surface configured to engage with the inner arm.

In various exemplary aspects, the rocker arm assembly can further comprise a push pin seated in the inner arm. The push pin can be configured to selectively push the latch pin from the latched position to the unlatched position to allow the outer arm to rotate relative to the inner arm. According to one exemplary aspect, the inner arm can comprise an inner bore for movably receiving the push pin. The inner bore can be located in a stepped portion of the inner arm, where the stepped portion can define an inner latch surface configured to engage with the latch pin in the latched position.

According to another exemplary aspect, the movement of the push pin can be controlled hydraulically, and the inner arm can define a hydraulic passageway for supplying a control fluid from an oil gallery adjacent the rocker shaft to the push pin in the inner bore.

In still another exemplary aspect, the connecting portion can comprise a connector tab extending from a top surface of the inner arm in a direction away from the inner rocker shaft bore.

In some exemplary aspects, the outer arm can comprise a pair of side walls extending substantially parallel to each other in a direction substantially perpendicular to a rotating axis of the rocker shaft, where the inner arm can be rotatably disposed at least partially between the pair of side walls. Accordingly, the lost motion spring can comprise a pair of lost motion springs each connecting between the connecting portion of the inner arm and each of the side walls of the outer arm.

Various exemplary aspects of the present disclosure can also provide a rocker arm assembly including an outer arm and an inner arm. The outer arm can comprise an outer rocker shaft bore configured to receive a rocker shaft and a roller configured to interface with a camshaft lobe of a type III valve train assembly, where the roller can be located laterally from the outer rocker shaft bore. The inner arm can comprise an inner rocker shaft bore configured to receive the rocker shaft. The inner arm can be configured to selectively rotate relative to the outer arm via the rocker shaft extended through the outer rocker shaft bore and the inner rocker shaft bore. The rocker arm assembly can also comprise a latch pin movably seated in the outer arm above the roller and configured to move between a latched position, in which the latch pin engages with the inner arm to lock the relative rotation between the inner arm and the outer arm, and an unlatched position, in which the latch pin disengages with the inner arm to allow the relative rotation between the inner arm and the outer arm.

The rocker arm assembly can further comprise a lost motion spring comprising a first end connected to a connecting portion of the inner arm located above the inner rocker shaft bore and a second end connected to the outer arm at a location between the outer rocker shaft bore and the latch pin.

According to one exemplary aspect, the rocker arm assembly can further comprise a push pin seated in the inner arm, where the push pin can be configured to selectively push the latch pin from the latched position to the unlatched position to allow the outer arm to rotate relative to the inner arm. The inner arm can comprise an inner bore for movably receiving the push pin. In another exemplary aspect, the movement of the push pin can be controlled hydraulically, and the inner arm can define a hydraulic passageway for supplying a control fluid from an oil gallery adjacent the rocker shaft to the push pin in the inner bore.

According to still another exemplary aspect, the outer arm comprises a pair of side walls extending substantially parallel to each other in a direction substantially perpendicular to a rotating axis of the rocker shaft, wherein the inner arm is rotatably disposed at least partially between the pair of side walls. In yet still another exemplary aspect, the lost motion spring can comprise a pair of lost motion springs each connecting between the connecting portion of the inner arm and each of the side walls of the outer arm.

Additional objects and advantages will be set forth in part in the description which follows, and in part will be obvious from the description, or can be learned by practice of the disclosure. The objects and advantages will also be realized and attained by means of the elements and combinations particularly pointed out in the appended claims.

BRIEF DESCRIPTION OF THE DRAWINGS

The accompanying drawings, which are incorporated in and constitute a part of this specification, illustrate an exemplary embodiment of the present disclosure and together with the description, serve to explain the principles of the present disclosure.

DETAILED DESCRIPTION

Reference will now be made in detail to the examples which are illustrated in the accompanying drawings. Wherever possible, the same reference numbers will be used throughout the drawings to refer to the same or like parts. Directional references such as "left," "right," "above," and "below" are for ease of reference to the figures.

Figure 1:
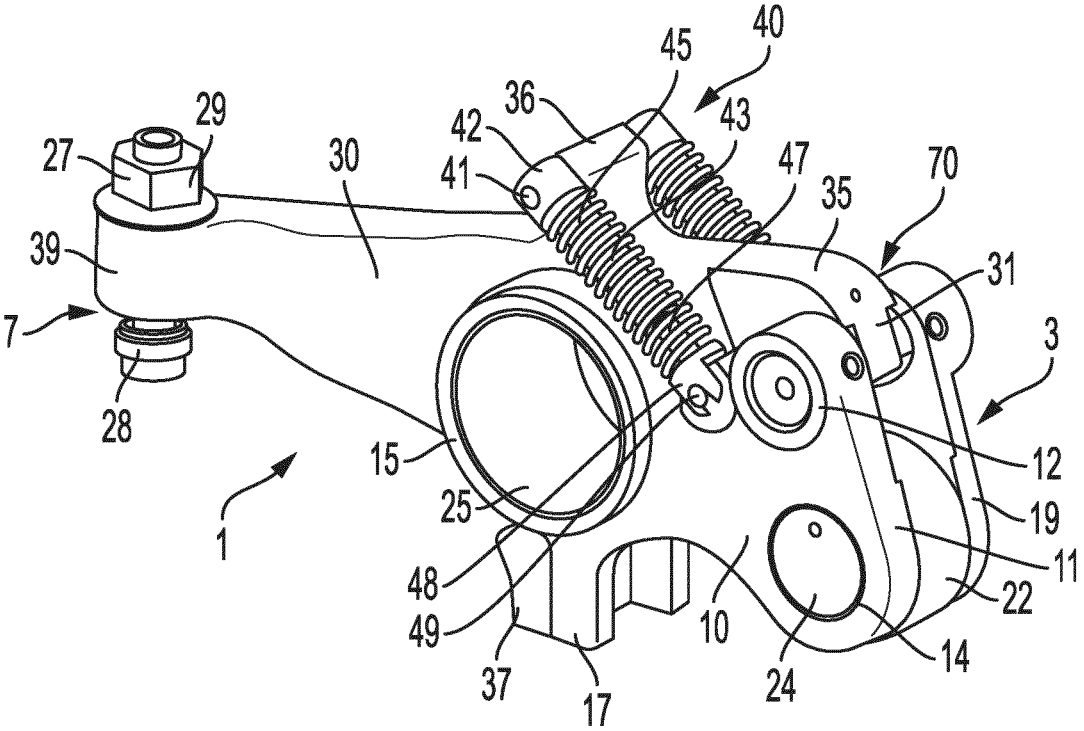
FIG. 1 is a perspective view of a rocker arm assembly, according to one exemplary embodiment of the present disclosure.
Figure 2:
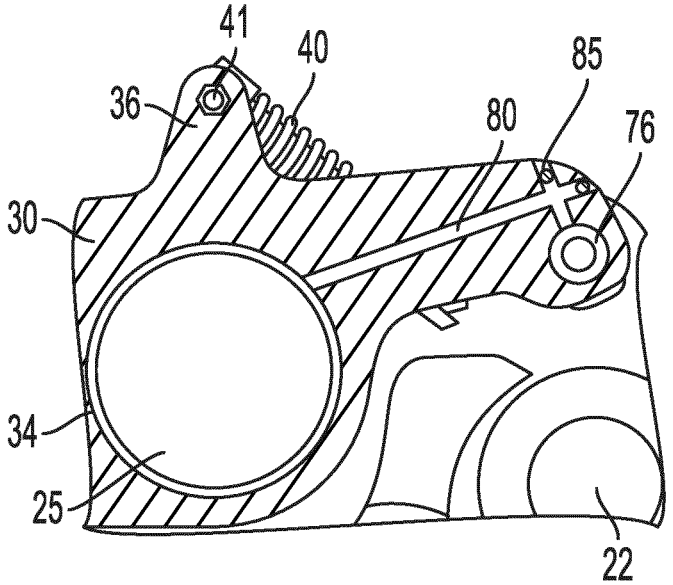
FIG. 2 is a partial sectional view of the rocker arm assembly of FIG. 1, illustrating a hydraulic passageway inside an inner arm from a rocker shaft to push pins.
Figure 3:
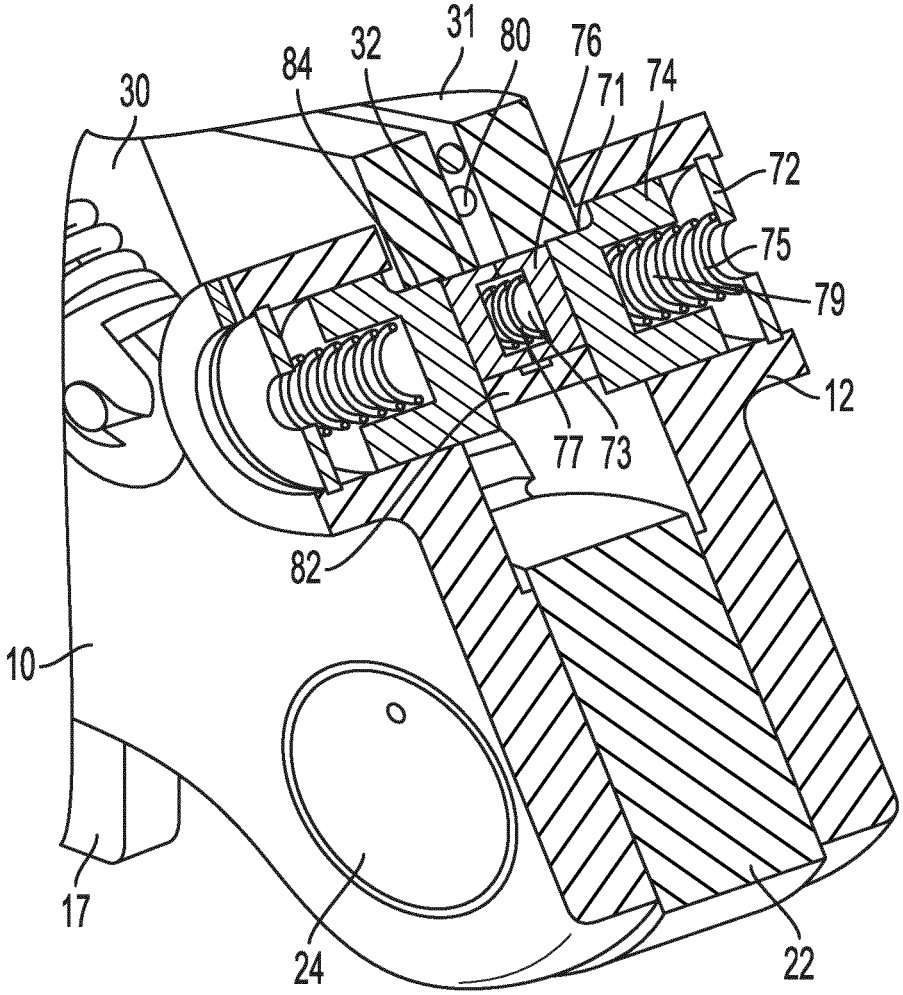
FIG. 3 is a sectional view of the rocker arm assembly of FIG. 1, illustrating an exemplary latching mechanism.

FIGS. 1-3 illustrate a switchable rocker arm assembly 1 for an internal combustion engine, according to one exemplary embodiment of the present disclosure. Rocker arm assembly 1 of the present disclosure can be configured to support various variable valve actuation mechanisms in internal combustion engines. While the exemplary embodiment of the present disclosure will be described in connection with a particular cylinder deactivation mechanism, the present disclosure can be applied to a variable valve lift system or any other suitable variable valve actuation mechanism. Further, while the disclosed embodiment will be described in connection with a particular type III valve train architecture (e.g., a single overhead camshaft configuration), the present disclosure can be applied to, or used in connection with, many other types of valve train systems and configurations.

Rocker arm assembly 1 can be positioned between a rotating camshaft lobe and a stem of a valve (or a lash adjuster) to control the lifting profile of the valve. For illustration purposes, one side of rocker arm assembly 1 that is configured to interface with the rotating camshaft lobe is referred to as a cam side 3, and the opposite side of rocker arm assembly 1 that is configured to interface with the valve stem is referred to as a valve side 7.

Rocker arm assembly 1 can comprise an outer arm 10, an inner arm 30, a latching mechanism 70, and a lost motion assembly 40. Outer arm 10 and inner arm 30 can be rotatably coupled to one another via a rocker shaft 25 having a rocker shaft axis. Rocker shaft 25 can be a free-floating axle to minimize wear and friction losses. Rocker shaft 25 can comprise a bushing or another structure to alleviate shear or wear or to provide alignment. Outer arm 10 can comprise a pair of side walls 11, 19 extending substantially parallel to each other. Side walls 11 and 19 can be connected to one another via a lateral surface extending therebetween. Lateral surface can comprise material connected to outer arm stop members 17 or material forming outer rocker shaft bore 15, for example. Inner arm 30 can be seated, at least partially, between side walls 11 and 19, as best shown in FIG. 1. Outer arm 10 can define an outer rocker shaft bore 15 in each of side walls 11 and 19, and inner arm 30 can define an inner rocker shaft bore 34. Rocker shaft 25 passes through, in sequence, outer rocker shaft bore 15 of side 11, inner rocker shaft bore 34, and outer rocker shaft bore 15 of side 19 to rotatably engage with outer arm 10 and inner arm 30.

Inner arm 30 can comprise a head portion 31 in cam side 3 and a tail portion 39 in valve side 7. Inner rocker shaft bore 34 can be located near the midpoint between head portion 31 and tail portion 39. Inner arm 30 can have a generally elongated body with its dimensional profile decreasing from inner rocker shaft bore 34 to tail portion 39. An elephant foot 28 can be coupled to tail portion 39 for directly or indirectly interfacing with a valve stem or any other suitable structure associated with a valve. Elephant foot 28 can be connected to a threaded rod 27 extending through a hole (not shown) defined inside tail portion 39. Threaded rod 27 can then be secured to tail portion 39 via a nut 29. Any other suitable coupling mechanism known in the art can be used alternatively or additionally. In some exemplary embodiments, tail portion 39 can also include a lash adjuster or other capsule associated with elephant foot 28. A switchable device, such as a castellation device, can be installed in the tail portion 39. An oil feed can be installed on or within inner arm 30 to provide control to the lash adjuster or switchable device or other capsule installed in tail portion 39. Such examples are not exhaustive and other variable valve actuation or lash adjusting capsules or other assemblies can be included on inner arm 30.

Outer arm 10 can comprise a roller 22 for interfacing with the rotating camshaft lobe of a valve train to impart a valve lift profile to rocker arm assembly 1. In the disclosed embodiment shown in FIG. 1, roller 22 is configured to interface with a camshaft lobe of a type III valve train assembly. Roller 22 is rotatably supported by a bearing shaft 24, which can be fixed to outer arm 10 between the pair of side walls 11 and 19. Bearing shaft 24 can include a needle bearing and/or a bushing bearing to minimize friction losses and wear. Side walls 11 and 19 each can define a bearing bore 14 to receive the ends of bearing shaft 24. In some exemplary embodiments, a sliding surface can be used instead of roller 22.

Latching mechanism 70 can be located above roller 22 for selectively locking and unlocking the relative rotational motion between outer arm 10 and inner arm 30. For example, as best shown in FIG. 1, roller 22 can be attached to one end of outer arm 10, which is located laterally with respect to rocker shaft 25, and latching mechanism 70 can be located above roller 22. Placing latching mechanism 70 directly above roller 22 can require less latching force over the prior art to operate latching mechanism 70. Yet, transfer of force from head portion 31 to tail portion 39 through the latching mechanism 70 remains efficient during a locked state. Being above roller 22 and laterally positioned away from the rocker shaft 25, instead of being over the rocker shaft 25 or nearer to the tail portion 39 yields a favorable balance of forces for switching between the locked state and the unlocked state. It can be said that the latching mechanism is laterally located so that the lost motion spring 45 is seated, as by connecting pin 49, between the outer rocker shaft bore 15 and the latching mechanism 70. In the locked state, outer arm 10 is prevented from rotating relative to inner arm 30, such that outer arm 10 and inner arm 30 can act as a single unit and directly translating the radial motion of the rotating camshaft lobe to a valve. In an unlocked state, outer arm 10 is allowed to rotate relative to inner arm 30, such that the radial motion of the rotating camshaft lobe transferred to outer arm 10 can be dissipated and lost.

As best shown in FIG. 3, latching mechanism 70 can comprise a pair of latch pins 74 seated in outer arm 10 and a pair of push pins 76 seated in inner arm 30. Each of side walls 11 and 19 can define a latch pin seat 12 to accommodate each latch pin 74. Latch pin seat 12 can be a hollow cylinder and include a flange 72 fixed near an outer end of the hollow cylinder away from inner arm 30. Latch pin 74 can have a shape of a cap having an internal recess 79. A return spring 75 can be disposed between flange 72 and latch pin 74 and at least partially received inside internal recess 79. Return spring 75 can be configured to bias latch pin 74 towards inner arm 30.

Latch pin 74 can form an outer latch surface 71 configured to engage with an inner latch surface 84 formed in inner arm 30. In one exemplary embodiment, outer latch surface 71 can comprise an indented flat surface on a side facing inner latch surface 84, as shown in FIG. 3. The indented flat surface, formed by, for example, machining the side facing inner latch surface 84, may reduce contact stress and/or avoid concentricity issues. In an alternative embodiment, outer latch surface 71 can comprise a circumferentially stepped portion at the outer surface of latch pin 74. In another alternative embodiment, latch pin 74 can form a rounded pin shape without an indented flat surface or a stepped portion, and the rounded outer surface of latch pin 74 can serve as outer latch surface 71 for engaging with inner latch surface 84.

Head portion 31 of inner arm 30 can include a stepped portion 82, defining inner latch surface 84 configured to engage with outer latch surface 71 of latch pin 74. In stepped portion 82, inner arm 30 can form an inner bore 32 extending through the entire width of stepped portion 82 in a direction parallel to the rotating axis of rocker shaft 25. The pair of push pins 76 can be seated inside inner bore 32. Each push pin 76 can form an internal recess on the side facing the other push pin 76, such that the pair of push pins 76 can collectively form a pressure chamber 73 therebetween. Each push pin 76 can be configured to selectively extend out of inner bore 32 and push corresponding latch pin 74 into latch pin seat 12 of outer arm, so that outer arm 10 can rotate relative to inner arm 30.

In some exemplary embodiments, a push pin spring 77 can be disposed inside pressure chamber 73 to exert outwardly spring force against the pair of push pins 76. The spring force of push pin spring 77 (e.g., spring constant) can be less than that of return springs 75, so that push pins 76 can be normally kept retracted inside inner bore 32 of inner arm 30. In another exemplary embodiment, push pin spring 77 can be completely omitted.

The movement of push pins 76 can be hydraulically controlled. For example, as best shown in FIG. 2, inner arm 30 can define a hydraulic passageway 80 for supplying a control fluid (e.g., engine oil) from an oil gallery on rocker shaft 25 and/or inner rocker shaft bore 34 to pressure chamber 73. Inner arm 30 can use one or more valves, plugs, and/or flow diverters 85 to define hydraulic passageway 80 and seal off any unintended leakage paths.

Figure 4:
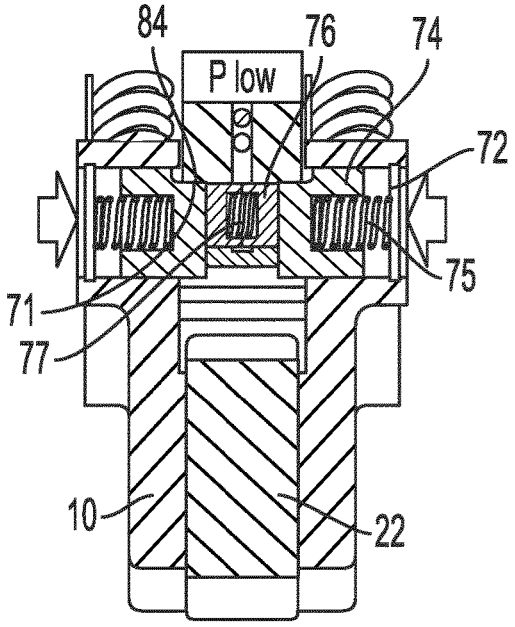
FIG. 4 is a section view of the rocker arm assembly of FIG. 1, illustrating the latching mechanism in a latched state.
Figure 5:
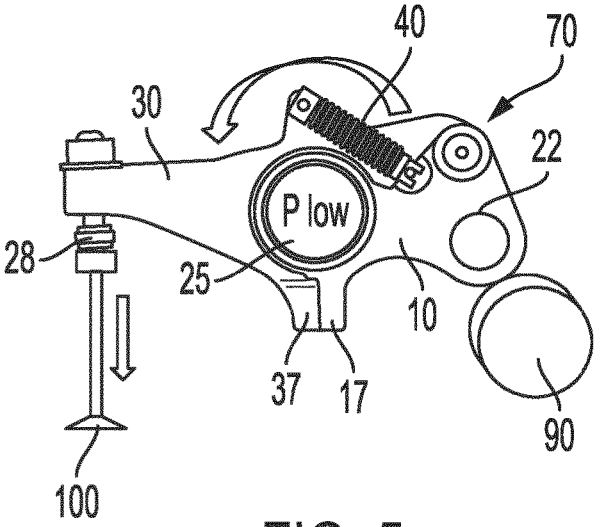
FIG. 5 is a schematic illustrating an operation of the rocker arm assembly of FIG. 1 in the latched state.
Figure 6:
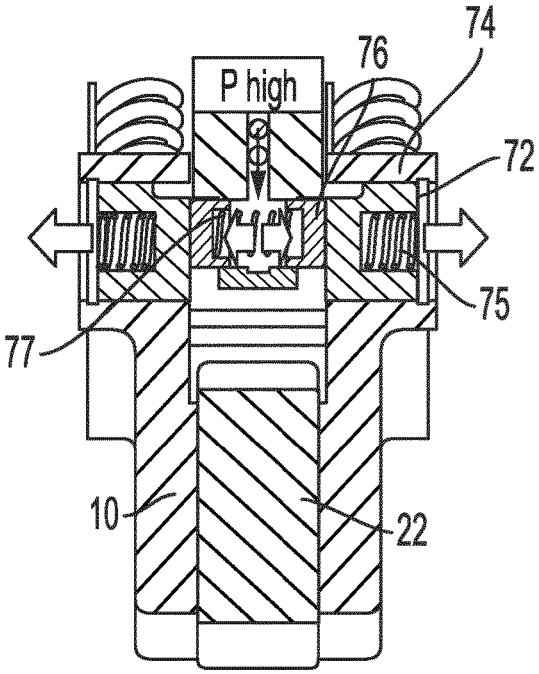
FIG. 6 is a section view of the rocker arm assembly of FIG. 1, illustrating the latching mechanism in an unlatched state.
Figure 7:
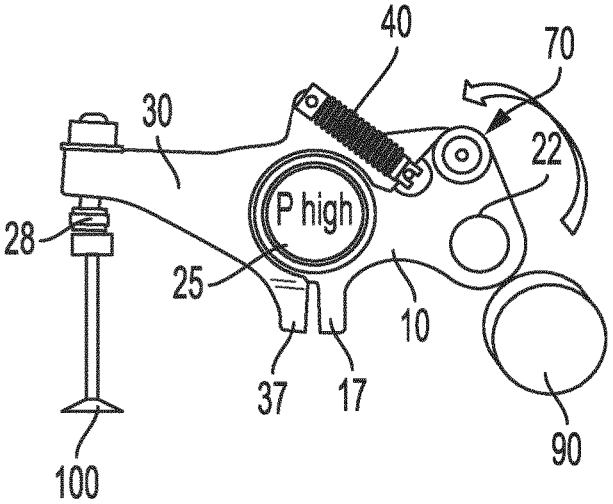
FIG. 7 is a schematic illustrating the operation of the rocker arm assembly of FIG. 1 in the unlatched state.

FIGS. 4 & 5 and FIGS. 6 & 7 schematically illustrate exemplary operational characteristics of rocker arm assembly 1 when latching mechanism 70 is in a latched state and an unlatched state, respectively. According to one exemplary aspect, the latched state can represent a normal, steady condition, where latching mechanism 70 locks outer arm 10 from rotating relative to inner arm 30. In this latched state, the radial motion of a rotating camshaft lobe 90 can be transmitted to a valve 100 via rocker arm assembly 1, as illustrated in FIG. 5. On the other hand, the unlatched state can represent a special, deactivated condition, where latching mechanism 70 allows outer arm 10 to rotate relative to inner arm 30. In this unlatched state, the radial motion of rotating camshaft lobe 90 is not transmitted to valve 100, as illustrated in FIG. 7.

During the latched state, the hydraulic pressure of the control fluid is kept below a threshold pressure required to overcome the force of return springs 75. Consequently, return springs 75 can keep latch pins 74 extended from outer arm 10 and into stepped portion 82 of inner arm 30 with outer latch surfaces 71 of latch pins 74 engaging inner latch surfaces 84 of inner arm 30, as shown in FIG. 4. To transition from the latched state to the unlatched state, the hydraulic pressure of the control fluid can be increased above the threshold pressure to overcome the force of return springs 75. The increased hydraulic pressure increases the pressure inside pressure chamber 73, which in turn can extend push pins 76 out of inner bore 32 and push latch pins 74 out of stepped portion 82 and into a retracted position inside outer arm 10, as shown in FIG. 6, thereby permitting the rotation of outer arm 10 relative to inner arm 30.

As mentioned above, rocker arm assembly 1 can comprise lost motion assembly 40 that biases outer arm 10 away from inner arm 30 in order to maintain contact between roller 22 and camshaft lobe 90 during an unlatched state. To provide a rotational stop mechanism, of outer arm 10 can comprise one or more outer arm stop members 17, and inner arm 30 can comprise one or more inner arm stop members 37, as shown in FIG. 1. One or both side walls 11, 19 of outer arm 10 can comprise an outer arm stop member 17 or outer arm stop member can comprise a body portion that connects side walls 11, 19 for coordinated rotation.

Each outer arm stop member 17 is aligned to contact with a corresponding inner arm stop member 37. In an unlatched state, outer arm 10 is no longer locked with inner arm 30 and is allowed to rotate relative to inner arm 30 in a first rotational direction. During this unlatched state, inner arm stop member 37 and outer arm stop member 17 can prevent outer arm 10 from rotating in a second rotational direction opposite to the first rotational direction past a predetermined position.

According to some exemplary aspects, outer arm stop members 17 and inner arm stop members 37 can be positioned right below rocker shaft 25 in a space often regarded as dead space. For example, one or more outer arm stop members 17 can extend below from the periphery of outer rocker shaft bore 15, and one or more corresponding inner arm stop members 37 can extend below from the periphery of inner rocker shaft bore 34.

Referring to FIG. 1, rocker arm assembly 1 can comprise a pair of lost motion assemblies 40 each connecting inner arm 30 to each of side walls 11 and 19 of outer arm 10. In some alternative embodiments, rocker arm assembly 1 can include only one lost motion assembly 40 connecting inner arm 30 to only one of side walls 11 and 19.

Lost motion assembly 40 can comprise a header 42, a footer 48, and a lost motion spring 45 disposed between header 42 and footer 48. Header 42 can be coupled to inner arm 30, and footer 48 can be coupled to outer arm 10. To facilitate the coupling, inner arm 30 can comprise a connector tab 36 extending upwardly from its top surface 35. Header 42 can be coupled to connector tab 36 via a connector pin 41 which extends through header 42 in a direction parallel to the rotating axis of rocker shaft 25. Connector pin 41 can be a pivot pin allowing header 42 to rotate in a radial direction substantially perpendicular to the rotating axis of rocker shaft 25. Like header 42, footer 48 can be rotatably coupled to outer arm 10 via a connecting pin 49. The portion of outer arm 10 to which footer 48 is connected can be located approximately between roller 22 and rocker shaft 25 and between rocker shaft 25 and latch pin seat 12. According to one exemplary aspect of the present disclosure, connector tab 36 is located above inner rocker shaft bore 34, and inner arm step member 37 extends below inner rocker shaft bore 34 from a side substantially opposite to connector tab 36 with respect to inner rocker shaft bore 34. Connector tab 36 can be centered over the inner rocker shaft bore 34 with the lost motion spring 45 being tangent to the outer rocker shaft bore 15.

According to another exemplary aspect, a header stem 43 extends from header 42, and a footer stem 47 extends from footer 48. Header stem 43 can be a tubular member sized and configured to slidably receive footer stem 47 therein. Lost motion spring 45 is positioned over header stem 43 and footer stem 47. Accordingly, the inner diameter of lost motion spring 45 can be greater than the outer diameter of header stem 43 and less than the footprints of header 42 and footer 48. When outer arm 10 is rotated relative to inner arm 30 during an unlatched state, the distance between header 42 and footer 48 can be reduced, causing lost motion spring 45 to exert spring force against outer arm 10. This spring force can maintain reliable contact between roller 22 and camshaft lobe 90 during the movement of outer arm 10 relative to inner arm 30, while compensating the inertia force of moving inner arm 10.

Other implementations will be apparent to those skilled in the art from consideration of the specification and practice of the examples disclosed herein.

What is claimed is:

1. A rocker arm assembly comprising:

an outer arm comprising:

a pair of side walls;

an outer rocker shaft bore configured to receive a rocker shaft; and a roller configured to interface with a camshaft lobe of a type III valve train assembly, the roller located laterally from the outer rocker shaft bore;

an inner arm comprising an inner rocker shaft bore configured to receive the rocker shaft, the inner arm configured to selectively rotate relative to the outer arm via the rocker shaft;

a latch pin seated in the outer arm, the latch pin configured to move in a direction parallel to a rotating axis of the rocker shaft between (i) a latched position in which the latch pin engages the inner arm so as to lock the relative rotation between the inner arm and the outer arm, and (ii) an unlatched position in which the latch pin disengages from the inner arm so as to enable the relative rotation between the inner arm and the outer arm; and a pair of longitudinal lost motion springs extending in a direction perpendicular to the rotating axis of the rocker shaft, each lost motion spring comprising:

a first end connected to a connecting portion of the inner arm located above the inner rocker shaft bore, and a second end of each lost motion spring connected to a respective sidewall of the pair of side walls.

2. The rocker arm assembly of claim 1, further comprising a push pin seated in the inner arm, the push pin configured to selectively push the latch pin from the latched position to the unlatched position.

3. The rocker arm assembly of claim 2, wherein the inner arm further comprises an inner bore configured to receive the push pin.

4. The rocker arm assembly of claim 3, wherein a movement of the push pin is controlled hydraulically, and the inner arm defines a hydraulic passageway configured to supply a control fluid from an oil gallery to the push pin in the inner bore.

5. The rocker arm assembly of claim 1, wherein the pair of side walls extend parallel to each other in the direction perpendicular to the rotating axis of the rocker shaft, wherein the inner arm is disposed at least partially between the pair of side walls.

6. A rocker arm assembly comprising:

an outer arm comprising:

a pair of sidewalls;

an outer arm stop member; and an outer rocker shaft bore configured to receive a rocker shaft;

an inner arm comprising:

an inner arm stop member configured to contact the outer arm stop member; and an inner rocker shaft bore configured to receive the rocker shaft, the inner arm configured to selectively rotate relative to the outer arm via the rocker shaft;

a latch pin seated in the outer arm and configured to move in a direction parallel to a rotating axis of the rocker shaft between (i) a latched position in which the latch pin engages the inner arm so as to lock the relative rotation between the inner arm and the outer arm, and (ii) an unlatched position in which the latch pin disengages from the inner arm so as to enable the relative rotation between the inner arm and the outer arm; and a pair of longitudinal lost motion springs extending in a direction perpendicular to the rotating axis of the rocker shaft, each lost motion spring comprising:

a first end connected to a connecting portion of the inner arm located above the inner rocker shaft bore, and a second end of each lost motion spring connected to a respective sidewall of the pair of sidewalls, wherein the inner arm stop member extends below the inner rocker shaft bore from a side opposite to the connecting portion of the inner arm.

7. The rocker arm assembly of claim 6, wherein the outer arm further comprises a roller configured to interface with a camshaft lobe of a type III valve train assembly.

8. The rocker arm assembly of claim 7, wherein the roller is located laterally from the rocker shaft, and the latch pin is located above the roller.

9. The rocker arm assembly of claim 7, wherein the second end of each lost motion spring is connected to a portion of the respective sidewall located between the roller and the rocker shaft.

10. The rocker arm assembly of claim 7, wherein the second end of the lost motion spring is connected to a portion of the respective sidewall located between the rocker shaft and the latch pin.

11. The rocker arm assembly of claim 6, wherein the outer arm further comprises: a latch pin seat configured to receive the latch pin;

a flange fixed to the latch pin seat on a side away from the inner arm; and a return spring disposed between the flange and the latch pin so as to bias the latch pin towards the inner arm.

12. The rocker arm assembly of claim 6, wherein the latch pin includes an indented flat surface configured to engage with the inner arm.

13. The rocker arm assembly of claim 6, further comprising a push pin seated in the inner arm, the push pin configured to selectively push the latch pin from the latched position to the unlatched position.

14. The rocker arm assembly of claim 13, wherein the inner arm further comprises an inner bore configured to receive the push pin.

15. The rocker arm assembly of claim 14, wherein the inner bore is located in a stepped portion of the inner arm, wherein the stepped portion defines an inner latch surface configured to engage the latch pin in the latched position.

16. The rocker arm assembly of claim 13, wherein a movement of the push pin is controlled hydraulically, and the inner arm defines a hydraulic passageway configured to supply a control fluid from an oil gallery to the push pin in the inner bore.

17. The rocker arm assembly of claim 6, wherein the connecting portion includes a connector tab extending from a top surface of the inner arm in a direction away from the inner rocker shaft bore.

18. The rocker arm assembly of claim 6, wherein the pair of side walls extend parallel to each other in the direction perpendicular to the rotating axis of the rocker shaft, wherein the inner arm is disposed at least partially between the pair of side walls.

* * * * *